US009175899B2

(12) United States Patent
Takahashi et al.

(10) Patent No.: US 9,175,899 B2
(45) Date of Patent: Nov. 3, 2015

(54) AIR CONDITIONER

(75) Inventors: Masaya Takahashi, Osaka (JP); Masaki Ohtsuka, Osaka (JP); Yukishige Shiraichi, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 218 days.

(21) Appl. No.: 13/977,745

(22) PCT Filed: Dec. 26, 2011

(86) PCT No.: PCT/JP2011/080094

§ 371 (c)(1),
(2), (4) Date: Jul. 1, 2013

(87) PCT Pub. No.: WO2012/096127

PCT Pub. Date: Jul. 19, 2012

(65) Prior Publication Data

US 2013/0276473 A1 Oct. 24, 2013

(30) Foreign Application Priority Data

Jan. 11, 2011 (JP) ..... 2011-002808

(51) Int. Cl.

| | |
|---|---|
| ***F25D 17/06*** | (2006.01) |
| ***F25D 17/08*** | (2006.01) |
| ***F24F 1/00*** | (2011.01) |
| *F24F 13/24* | (2006.01) |

(52) U.S. Cl.

CPC ..... *F25D 17/08* (2013.01); *F24F 1/0011* (2013.01); *F24F 13/24* (2013.01); *F24F 2001/0048* (2013.01)

(58) Field of Classification Search

CPC ..... F24F 1/0011; F24F 1/0025; F24F 13/24

USPC ..... 62/411, 419, 412, 409

See application file for complete search history.

(56) References Cited

U.S. PATENT DOCUMENTS 4,958,504 A * 9/1990 Ichikawa et al. ..... 62/244

FOREIGN PATENT DOCUMENTS

| | | | | |
|---|---|---|---|---|
| JP | 58-6993 U | | 1/1983 | |
| JP | 08-121395 A | | 5/1996 | |
| JP | 2000-291973 A | | 10/2000 | |
| JP | 2004-125280 A | | 4/2004 | |
| JP | 2004125280 A | * | 4/2004 | ..... F24F 1/00 |

OTHER PUBLICATIONS

Official Communication issued in International Patent Application No. PCT/JP2011/080094, mailed on Mar. 27, 2012.

* cited by examiner

*Primary Examiner* — Cheryl J Tyler
*Assistant Examiner* — Elizabeth Martin
(74) *Attorney, Agent, or Firm* — Keating & Bennett, LLP

(57) ABSTRACT

An air conditioner includes: an air passage extending from a suction port to a blowout port, a heat exchanger at the upstream side of the air passage, a cross flow fan in the air passage on the downstream side of the heat exchanger, and an air passage wall provided in a downstream area of the cross flow fan to reach the blowout port. A restricting section that restricts an air passage sectional area is provided at a corner section of the side wall of the air passage wall. The restricting section has a shape by which the air passage sectional area has a rectangular cross section expanding from the upstream side to the downstream side and is restricted to reduce an enlargement ratio of the air passage sectional area. Further, the restricting section has a smooth restricting surface crossing the corner section of the cross section of the air passage.

4 Claims, 5 Drawing Sheets

AIR CONDITIONER

TECHNICAL FIELD

The present invention relates to an air conditioner provided with a cross flow fan.

BACKGROUND ART

In a recent energy saving trend, there has been an increasing demand for improving the performance of an air blower of an air conditioner. The performance of an air blower is enhanced by improving the flow characteristic of the air passage in which the air blower is arranged, and by reducing the noise level.

In order to respond to the demand, in the conventional air conditioner, the performance of the air blower is improved by expanding the suction port of the air passage and by increasing the minimum distance between the stabilizer and the rear guider which are respectively arranged on the front and rear sides of the cross flow fan configuring the air blower.

However, with such means, the performance of the air blower can be improved, but the air blower becomes a low static pressure type. For this reason, there is a problem that, when a large amount of dust and dirt adhere to the air filter arranged at the suction port in actual use, that is, during high dust load, the amount of air blown out from the blowout port is not stabilized, and thereby the air flow characteristics are deteriorated.

Further, the air conditioner provided with the cross flow fan has a characteristic that, when a load is applied to the cross flow fan, in the vicinity of the side wall of each of the left and right ends of the blowout port, the flow of blown out air tends to become unstable due to the influence of the resistance of the side wall, and to generate abnormal "flapping" sound which also becomes the cause of the noise.

In order to solve the above described problem, Patent Literature 1 proposes a structure in which a protrusion is formed to extend in the vicinity of the side wall of each of the left and right end sections of the blowout port, and thereby the peeled flow of air blown out along the rear guider is smoothed so as to reduce noise.

Further, Patent Literature 1 proposes another form that is configured to reduce noise in such a manner that a protrusion having a two-stage level difference along the air flow direction of the air passage is provided at each of the side walls in the downstream area of the cross flow fan, and thereby the width of the air passage sectional area, which is expanded in the rotating shaft direction of the cross flow fan from the upstream side to the downstream side of air flow, is reduced by the two-stage level difference, so as to reduce the variation components of the air passage in the rotating shaft direction to smooth the flow of blown out air.

CITATION LIST

Patent Literature

Patent Literature 1: Japanese Patent Laid-Open No. 2000-291973

SUMMARY OF INVENTION

Technical Problem

However, since any of the protrusions exemplified in Patent Literature 1 is provided with a corner section projected in the angular state to the side of the air passage, the air flowing through the air passage collides with the projecting corner section to produce a turbulent flow, and hence the instability of the air flow cannot be completely eliminated, which hinders the reduction of noise. Further, although the two-stage level difference is effective to reduce a change in the air passage sectional area, the level differences are used only as a gradual reduction measure. Therefore, a measure that can further stabilize and smooth the air flow in the area near the side wall, in which area the air flow tends to become unstable, and also a measure for further reducing noise have been desired.

In view of the above, an object of the present invention is to provide an air conditioner which can further smooth the air flow and reduce noise while maintaining the air blowing efficiency.

Solution to Problem

In order to achieve the above described object, according to the present invention, there is provided an air conditioner including, in a housing: an air passage extending from a suction port to a blowout port; a heat exchanger arranged on the upstream side of the air passage; a cross flow fan arranged in the air passage on the downstream side of the heat exchanger; an air passage wall provided in a downstream area of the cross flow fan to reach the blowout port; and a restricting section that is provided at a corner section of a side wall of the air passage wall, the side wall being located at each of both shaft direction ends of the cross flow fan, and having a shape by which, in the downstream area of the cross flow fan, the air passage sectional area expanding from the upstream side to the downstream side is restricted so as to reduce an enlargement ratio of the air passage sectional area, in which the restricting section has a smooth restricting surface crossing the corner section of the rectangular cross-section of the air passage, and the cross-sectional shape of the restricting surface is set to be gradually enlarged from the upstream side to the downstream side of the air flow.

In the above-described configuration, the air passage wall extending from the cross flow fan to the blowout port is formed in a tubular shape having a rectangular cross-section. However, in order to obtain good air blowing efficiency of the cross flow fan, it is desirable to gradually expand the air passage sectional area in the downstream area of the cross flow fan. In a tubular air passage in which the air passage sectional area is not changed from the upstream side to the downstream side in the air blowing direction, the static pressure in the vicinity of the side wall of the air passage becomes too high, so that the air blowing efficiency is not improved. On the other hand, when in the downstream area of the air flow from the cross flow fan, the enlargement ratio of the air passage sectional area is increased too much from the upstream side to the downstream side, the static pressure in the vicinity of each of the left and right side walls of the air passage becomes too low, and thereby a reverse air flow phenomenon is generated in the vicinity of each of the left and right side walls, so as to cause a trouble, such as generation of flapping noise.

Therefore, in the present embodiment, the restricting section is formed at the side wall of the air passage wall in order to prevent that the enlargement ratio of the air passage sectional area is increased too much from the upstream side to the downstream side of the air flow. When the width or the height of the cross-sectional shape of the restricting section is set so as to gradually increase from the upstream side to the downstream side in the air blowing direction, the air blowing efficiency can be stabilized.

Specifically, a restricting section having a triangular cross-sectional shape can be exemplified. In this case, the restricting surface facing the air passage can be formed into a smooth planar surface or a smooth concave curved surface (cross sectional R shape) recessed from the air passage, in order to prevent the restricting surface from becoming air-blowing resistance.

Advantageous Effects of Invention

As described above, in the air conditioner according to the present invention, the restricting section is arranged at the corner section of the side wall of the air passage and is formed to have the shape by which the air passage sectional area is gradually changed.

Therefore, in the area near the side wall in which area the air flow tends to become unstable, the air flow can be stabilized, and the static pressure can be increased while the air-blowing resistance is minimized.

DESCRIPTION OF EMBODIMENTS

In the following, an embodiment according to the present invention will be described with reference to the accompanying drawings. In the present embodiment, an indoor unit of a separate type air conditioner will be described as an example. In the air conditioner of this type, a heat exchanger housed in an indoor unit, and a compressor, a four way valve, an outdoor heat exchanger, and a restriction device (all not shown), which are housed in an outdoor unit (not shown), are connected by a refrigerant pipe to form a refrigerating cycle, and thereby various modes of operation, such as cooling, heating, and dehumidification operations, can be performed.

Figure 5:
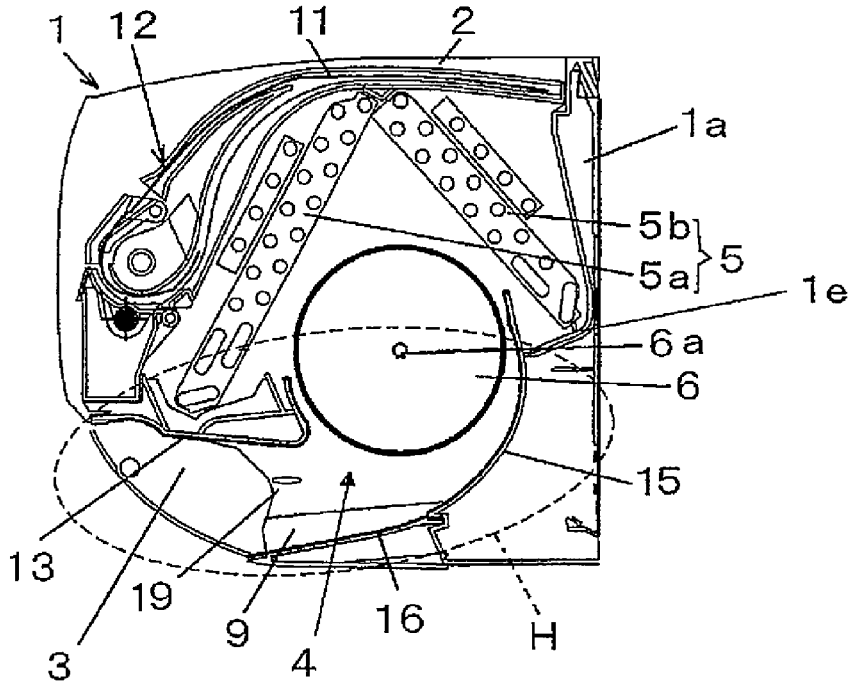
FIG. 5 is a sectional view taken along line A-A in FIG. 3.
Figure 6:
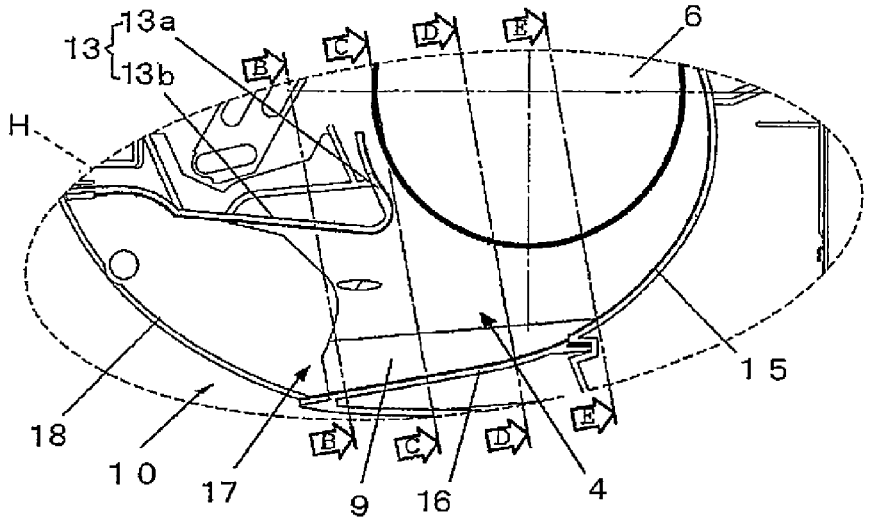
FIG. 6 is an enlarged sectional view showing a portion H of the blowout port of FIG. 5.

As shown in FIG. 5, the indoor unit includes, in a housing 1, an air passage 4 extending from a suction port 2 to a blowout port 3, a heat exchanger 5 arranged on an upstream side of the air passage 4, a cross flow fan 6 arranged in the air passage 4 on a downstream side of the heat exchanger 5, and a tubular air passage wall 7 arranged in a downstream area of the cross flow fan 6 to reach the blowout port 3. Further, a restricting section 9 having a shape for restricting the air passage sectional area is formed at each of corner sections of left and right side walls 8 of the air passage wall 7, which side walls are respectively provided at both shaft-direction ends of the cross flow fan 6. The restricting section 9 is formed into a shape by which, in a downstream area of the cross flow fan 6, the air passage sectional area expanding from the upstream side to the downstream side is restricted so that the enlargement ratio of the air passage sectional area is reduced.

Figure 1:
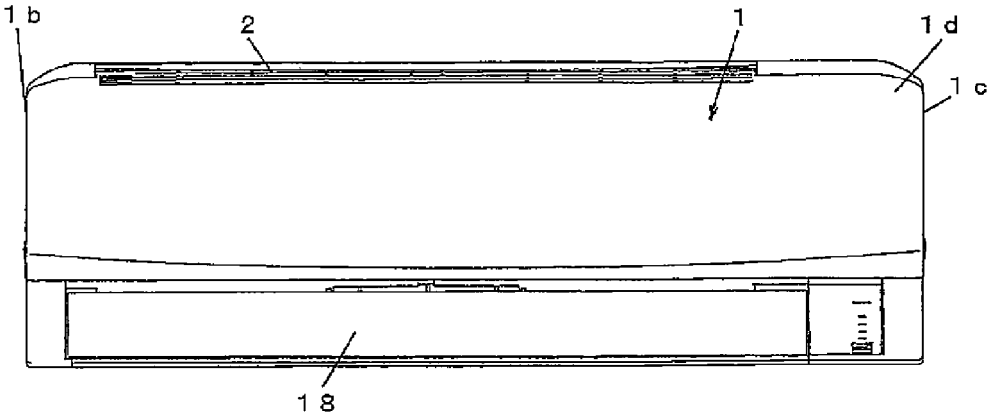
FIG. 1 is a front view showing an external view of an indoor unit of an air conditioner in a present embodiment.
Figure 2:
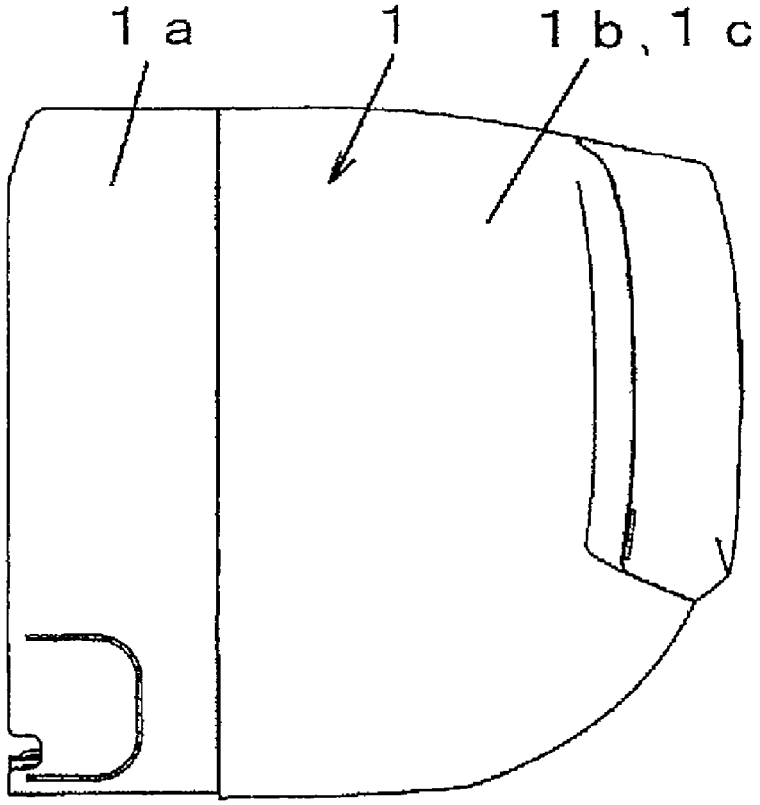
FIG. 2 is an external side view of the indoor unit.
Figure 3:
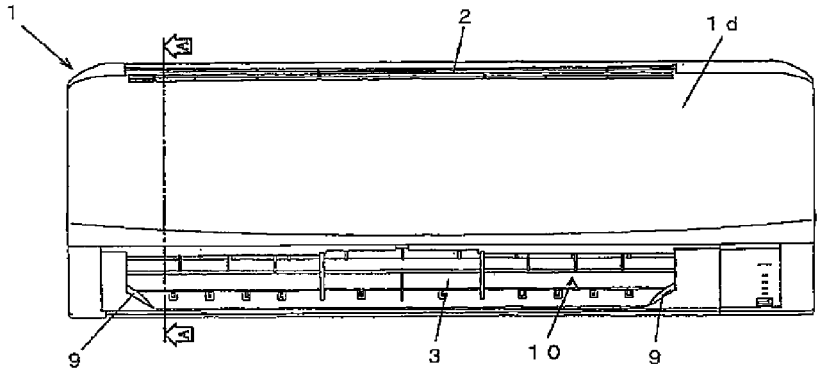
FIG. 3 is a front view of the indoor unit, which shows a state where a lateral louver is taken out from a blowout port of the indoor unit.
Figure 4:
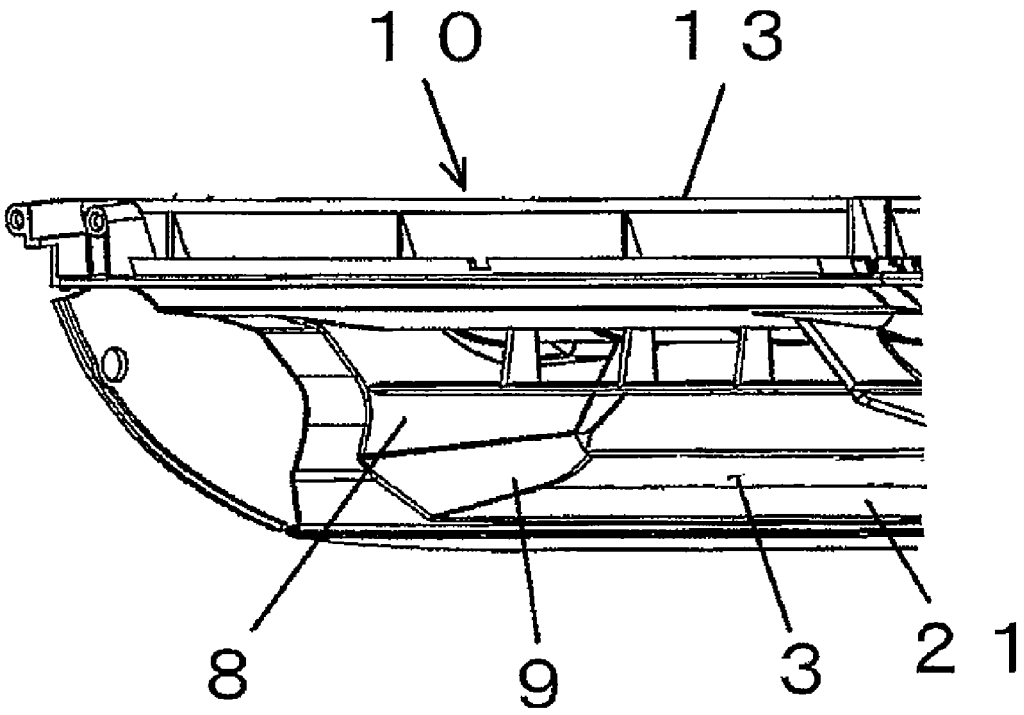
FIG. 4 is a perspective view showing a side wall section of the blowout port of FIG. 3.

As shown in FIG. 1 to FIG. 3, the housing 1 is formed in a box shape by combining together a rear plate 1*a*, left and right covers 1*b* and 1*c*, and a front panel 1*d*, and a louver unit 10, so as to configure an outer case of the indoor unit.

The rear plate 1*a* is formed in a box shape opened on the front side thereof so as to hold the cross flow fan 6 and a part of the heat exchanger 5. The rear surface of the rear plate 1*a* is provided with a planar section which can be attached to an indoor wall. Further, a rear guide wall 15 (rear guider), by which the air blown out from the cross flow fan 6 is guided to the blowout port 3, is provided on the front surface side of the rear plate 1*a*. Further, each of the left and right side walls of the rear plate 1*a* rotatably supports a rotating shaft section 6*a* of the cross flow fan 6.

The left and right covers 1*b* and 1*c* of the housing 1 respectively cover the left and right sides of the rear plate 1*a*, so that a space section is formed by the left and right side walls of the rear plate 1*a* and the left and right covers 1*b* and 1*c* so as to be able to accommodate therein the motor and electrical components of the cross flow fan 6.

As shown in FIG. 5, the suction port 2 is formed in a top surface section of the housing 1, which section is surrounded by the front panel 1*d* and the rear plate 1*a*. An air filter 11, which removes dust from the air sucked to the air passage 4 of the housing 1, is arranged on the back surface side of the top surface section.

Further, as shown in FIG. 5, a cleaning unit 12, which is provided with a brush for cleaning the air filter 11 and a dust box, is incorporated between the front panel 1*d* and the heat exchanger 5 arranged in the housing 1. The air filter 11 is inserted into the guide passage of the cleaning unit 12 so as to be movable along the suction port 2. Further, the air filter 11 can be taken out from the front side by opening the front panel 1*d*.

The heat exchanger 5 is provided in the vicinity of the suction port 2 on the air-flow upstream side of the air passage 4. The heat exchanger 5 is configured by arranging a front-side heat exchanger 5*a* and a rear-side heat exchanger 5*b* in a reverse V-shape in side view.

A drain pan 13, which is a component of the louver unit 10 and which has an upward-opening U shape in cross section, is arranged under the front-side heat exchanger 5*a*. A drain pan 1*e* formed on the rear surface side of the rear guide wall 15 of the rear plate 1*a* is arranged under the rear-side heat exchanger 5*b*.

The air passage wall 7 is formed by the front and rear air flow guide walls and the left and right side walls 8 so as to have a tubular shape. Further, in order to improve the air blowing efficiency, the air passage wall 7 is configured such that the front and rear air flow guide walls are gradually expanded from the upstream side to the blowout port 3 on the downstream side so as to become largest at the front end section of the blowout port 3.

The front air flow guide wall of the air passage wall 7 is configured by a rear wall surface 13*a* and a bottom wall surface 13*b* of the drain pan 13. The rear air flow guide wall is configured by the rear guide wall 15 formed on the front side of the rear plate 1*a* of the housing 1, and by a lower member 16 configuring the air-flow guide surface connected to the rear guide wall 15 and reaching the blowout port 3.

The rear guide wall 15 is formed in a recessed curved surface so as to guide, toward the front side, the air blown out from the cross flow fan 6. A space is provided between the rear wall surface 13*a* of the drain pan 13 and the rear guide wall 15 on the side of the rear plate 1*a*, and the cross flow fan 6 is arranged in the space.

The left and right side walls 8 support the rotating shaft section 6*a* of the cross flow fan 6. The restricting section 9 is arranged at the corner section formed by each of the left and right side walls 8 and by the rear side air flow guide wall. Even when the restricting section 9 is provided at a vertically central portion of each of the left and right side walls 8, or at an upper portion of each of the left and right side walls 8, the restricting effect of the air passage sectional area is obtained. However, the air flow tends to easily become unstable on a lower side (rear side) away from the cross flow fan. That is, at the corner section where each of the left and right side walls 8 crosses the rear side air flow guide wall, the air flow tends to more easily become unstable and also to become a starting point of the reverse air flow phenomenon. To cope with this, in the present embodiment, the air flow is made more stable by providing the restricting section 9 at the corner section where each of the left and right side walls 8 crosses the rear side air flow guide wall.

As described above, in a downstream area of the cross flow fan 6, the restricting section 9 restricts the air passage sectional area expanding from the upstream side to the downstream side, so that the enlargement ratio of the air passage sectional area is reduced. That is, the restricting section 9 includes a restricting surface 9*a* formed of a smooth surface crossing the corner section of the rectangular air passage cross-section, and the cross-sectional shape of the restricting surface 9*a* is set to be gradually enlarged from the upstream side to the downstream side of the air flow.

Specifically, the air passage cross-section, which is perpendicular to the direction of the air blown out from the cross flow fan 6 to reach the blowout port 3, is formed in a long rectangular shape in the left and right width direction. When the restricting section 9 having a triangular cross-section is arranged at the lower portion of each of the side walls 8, the air passage cross-section is formed to have a hexagonal cross-sectional shape.

Figure 7:
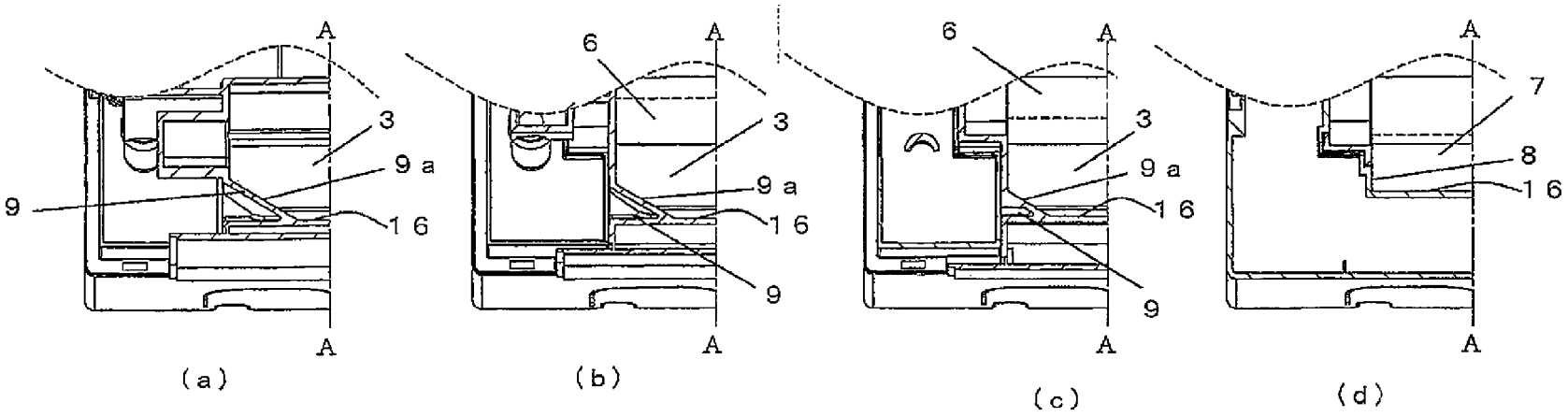
FIG. 7(*a*) is a sectional view taken along line B-B of FIG. 6, FIG. 7(*b*) is a sectional view taken along line C-C of FIG. 6, FIG. 7(*c*) is a sectional view taken along line D-D of FIG. 6, and FIG. 7(*d*) is a sectional view taken along line E-E of FIG. 6.
Figure 8:
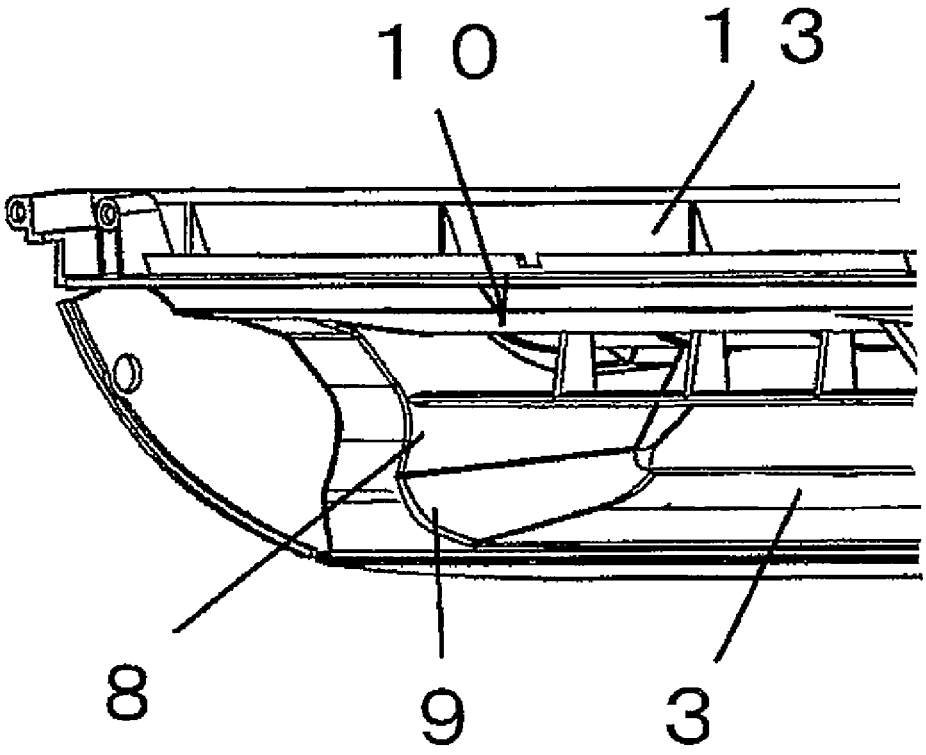
FIG. 8 is a perspective view showing a restricting section having a shape different from the shape of the restricting section shown in FIG. 4.

Further, as shown in FIG. 7, the restricting section 9 is formed to have a triangular cross-sectional shape, and the width dimension in the left-right direction is gradually increased from the upstream side to the downstream side of the air flow. Further, the height dimension of the triangular cross-sectional shape is set to be gradually increased from the upstream side to the downstream side of the air flow.

In other words, the restricting section 9 is formed in a three-sided pyramid shape which is arranged sideways so as to expand from the air-flow-direction upstream side to the blowout port 3 on the air-flow-direction downstream side. Therefore, the cross-sectional shape of the restricting section 9 is set to be gradually enlarged from the upstream side toward the downstream side in the air flow direction so as to become largest at the front end of the blowout port 3.

Further, the restricting surface 9*a* forming one side of the air passage cross-section of the restricting section 9 is formed into a planar smooth surface so as not to provide resistance to the air flow.

FIG. 7 shows respective shapes of the restricting section, in which FIG. 7(*a*) shows a shape of the restricting section at a front end portion of the blowout port 3, FIG. 7(*b*) shows a shape of the restricting section at a central portion of the blowout port 3 in the air flow direction, FIG. 7(*c*) shows a shape of the restricting section on the side of the cross flow fan of the blowout port, and FIG. 7(*d*) shows a shape of the restricting section nearest to the cross flow fan. From FIG. 7, it can be seen that the restricting section 9 is formed in the three-sided pyramid shape which is arranged sideways so as to expand from the air-flow-direction upstream side to the blowout port 3 on the air-flow-direction downstream side.

Note that the shape of the restricting surface 9*a* is not limited to the triangular cross-sectional shape shown in FIG. 7, but may also be formed, for example, in a shape of a smooth concave curved surface recessed from the air passage 4.

Further, in the present embodiment, in order to allow the cross flow fan 6 to be easily removed at the time of maintenance, the louver unit 10 provided at the blowout port 3 including a part of the air passage wall 7 is provided so as to be detachable from the housing 1.

The louver unit 10 includes a peripheral edge member 17, in the central portion of which the blowout port 3 is formed, a lateral louver 18 which is provided so as to be rotatable to the front side of the blowout port 3, a straightening plate 19 which is arranged on the rear side of the lateral louver 18 at the blowout port 3 so as to straighten the air blown out from the cross flow fan 6, and a plurality of vertical louvers (not shown) which are arranged on the rear side of the lateral louver 18 in a swingable manner.

The peripheral edge member 17 is configured in such a manner that the lower member 16 configuring the air flow guide surface which supports the vertical louvers in the swingable manner and which is connected to the rear guide wall 15 on the side of the rear plate 1*a*, the left and right side walls which respectively configure a part of the left and right side walls 8 and which serve as side walls of the blowout port 3, and the upper member which is configured by the drain pan 13 are integrally formed into a frame shape. The blowout port 3 is formed at the central portion of the peripheral edge member 17, and the restricting section 9 is formed at the lower portion of each of the left and right side walls of the peripheral edge member 17. The bottom wall surface 13*b* of the upper member configured by the drain pan 13 configures the upper side wall surface of the blowout port 3.

The lower member 16 configures a lower side outer case of the housing 1. The rear end section of the lower member 16 is locked to the front side section of the rear plate 1*a*, and the peripheral edge member 17 is fixed to the rear plate 1*a* of the housing 1 with screws. The upper surface of the lower member 16 is formed as an air flow guide surface which is gradually inclined downward toward the front side so as to be connected to the rear guide wall 15 of the rear plate 1*a*.

On the air flow guide surface of the lower member 16, the plurality of vertical louvers (not shown) are provided in the swingable manner, so that the air blown out from the cross flow fan 6 can be changed in the left and right direction. In FIG. 3 to FIG. 8, a state where the vertical louvers are omitted is illustrated in order to explain the configuration of the restricting section 9 of the blowout port 3.

The cross flow fan 6 has an impeller configured by cylindrically arranging a plurality of blades each having a predetermined length, and is configured such that a rotary shaft provided at each of the left and right ends of the impeller is rotatably supported by each of the left and right side walls (not shown) of the housing 1, and such that the air sucked from the side of the heat exchanger is blown out to the side of the blowout port 3 along the air passage wall 7 extending from the lower side to the front side.

The straightening plate 19 is arranged at a substantially intermediate position of the blowout port 3 in the vertical direction so as to substantially face the lower tip section which is located above the vertical louvers and which is a corner section formed by the rear wall surface 13*b* and the bottom wall surface 13*a* of the drain pan 13. Further, the straightening plate 19 is formed to have a flat elliptically-shaped cross-section so that turbulent flows generated around the lower tip section of the drain pan 13 can be straightened to be blown out toward the front side. The straightening plate 19 is extended between the left and right side walls of the peripheral edge member 17. In addition to the straightening function, the straightening plate 19 also has a role to prevent a user's fingertip from entering the blowout port 3 to contact the cross flow fan 6.

The lateral louver 18 is formed by one louver member, and each of left and right end sections of the lateral louver 18 is supported by each of the side walls of the peripheral edge member 17 so as to be rotatable about a rotary shaft whose axis direction is set in the left and right direction. The lateral louver 18 is driven by a lateral louver motor (not shown) connected to the rotary shaft.

The most of the restricting section 9 is formed at each of the left and right side walls of the louver unit 10, and only a slight part of the three-sided pyramid section on the upstream side is formed at each of the left and right wall surfaces of the rear plate. The restricting section 9 may have a form in which all portions thereof are formed in the louver unit.

In the above-described configuration, the air passage wall 7 extending from the cross flow fan 6 to the blowout port 3 is formed in a tubular shape, and it is desirable to gradually expand the air passage sectional area in the downstream area of the cross flow fan in order to obtain a good air blowing efficiency of the cross flow fan 6. In a tubular air passage whose air passage sectional area is not changed from the upstream side to the downstream side, the static pressure near the side wall becomes too high due to the resistance of the side wall in the downstream area of the cross flow fan 6, and hence the air blowing efficiency is not improved.

On the contrary, in the downstream area of the air flow from the cross flow fan, when the enlargement ratio of the air passage sectional area is increased too much from the upstream side to the downstream side of the air flow, the static pressure in the vicinity of each of the left and right side walls of the air passage becomes too low, and thereby a reverse air flow phenomenon is generated in the vicinity of each of the left and right side walls, so as to cause a trouble, such as generation of flapping noises.

Therefore, in order to prevent that the enlargement ratio of the air passage sectional area is increased too much from the upstream side to the downstream side of the air flow, the present embodiment is configured such that the restricting section 9 having a triangular cross-sectional shape is formed between the lower member of the blowout port 3 and each of the side walls, and such that the width and height of the restricting section 9 are set so as to gradually increase from the upstream side to the downstream side of the air flow to thereby stabilize the air flow.

In this way, in the present embodiment, since the air passage sectional area is gradually changed, and since the restricting section is formed to have the planar restricting surface so as not to project to the side of the air passage, the restricting section has a shape with no level difference. Therefore, when comparing with the case described in Patent Literature 1, in the present embodiment, the static pressure can be increased while the air-blowing resistance is suppressed to a minimum.

Note that the present invention is not limited to the above described embodiment, but numerous modifications and changes can be obviously made therein without departing from the spirit and scope of the present invention.

REFERENCE SIGNS LIST

1 Housing
1*a* Rear plate
1*b*, 1*c* Left and right covers
1*d* Front panel
1*e* Drain pan
2 Suction port
3 Blowout port
4 Air passage
5 Heat exchanger
5*a*, 5*b* Heat exchanger
6 Cross flow fan
7 Air passage wall
8 Side wall
9 Restricting section
10 Louver unit
11 Air filter
12 Cleaning unit
13 Drain pan
15 Rear guide wall
16 Lower member
17 Peripheral edge member
18 Lateral louver
19 Straightening plate

The invention claimed is:

1. An air conditioner comprising:

a housing including:

an air passage extending from a suction port to a blowout port;

a heat exchanger arranged on an upstream side of the air passage;

a cross flow fan arranged in the air passage on a downstream side of the heat exchanger;

an air passage wall provided in a downstream area of the cross flow fan to reach the blowout port; and a restricting section provided at a corner section of one of a left side wall and a right side wall of the air passage wall, the one of the left side wall and the right side wall being located at both shaft direction ends of the cross flow fan, the restricting section having a shape by which, in the downstream area of the cross flow fan, an air passage sectional area having a rectangular cross section expanding from the upstream side to the downstream side is restricted so as to reduce an enlargement ratio of the air passage sectional area, wherein the air passage wall is defined by a front air flow guide wall and a rear air flow guide wall and the left and right side walls so as to have a tubular shape, and the air passage wall is configured such that the front and rear air flow guide walls are expanded from the upstream side to the blowout port on the downstream side so that the air passage sectional area becomes largest at the front end section of the blowout port;

the restricting section has a restricting surface crossing the corner section of the cross section where each of the left and right side walls crosses the rear side flow guide wall, and the cross-sectional shape of the restricting section perpendicular to the air flow direction is defined in a triangular shape and set to be enlarged from the upstream side to the downstream side of the air flow; and the restricting section is positioned such that an extension line of the upper end of the restricting section which contacts one of the left side wall and the right side wall does not cross a plane including a front side of the air flow guide wall at any position, including at a front side of the blowout port.

2. The air conditioner according to claim 1, wherein a height of the restricting section increases from the upstream side to the downstream side in the air flow direction.

3. The air conditioner according to claim 1, wherein a width of the restricting section increases from the upstream side to the downstream side in the air flow direction.

4. The air conditioner according to claim 2, wherein the width of the restricting section increases from the upstream side to the downstream side in the air flow direction.

* * * * *